US006444624B1

(12) United States Patent
Walker et al.

(10) Patent No.: US 6,444,624 B1
(45) Date of Patent: Sep. 3, 2002

(54) LUBRICATING OIL COMPOSITION

(76) Inventors: Juliet V. Walker, 5 Thames Court Thames View Abingdon, Oxfordshire (GB), OX14 3GL; Ian A. Bell, 34 Blenheim Way Faringdon Road Southmoor, Oxfordshire (GB), OX13 5NQ ( * ) Notice: Subject to any disclaimer, the term of this patent is extended or adjusted under 35 U.S.C. 154(b) by 0 days.

(21) Appl. No.: 09/666,798

(22) Filed: Sep. 20, 2000

(51) Int. Cl.[7] ..... C10M 141/12

(52) U.S. Cl. ..... 508/363; 508/364; 508/369; 508/398; 508/539; 508/584

(58) Field of Search ..... 508/363, 331, 508/398, 369, 364, 539, 584

(56) References Cited

U.S. PATENT DOCUMENTS

| | | | | | |
|---|---|---|---|---|---|
| 5,356,547 | A | * | 10/1994 | Arai et al. | 508/364 |
| 5,558,802 | A | * | 9/1996 | Dowling | 508/391 |
| 5,627,146 | A | * | 5/1997 | Tanaka et al. | 508/363 |
| 5,658,862 | A | | 8/1997 | Vrahopoulou | 508/192 |
| 5,672,572 | A | * | 9/1997 | Arai et al. | 508/364 |
| 5,840,672 | A | | 11/1998 | Gatto | 508/334 |
| 5,888,945 | A | * | 3/1999 | Stiefel et al. | 508/363 |
| 5,895,779 | A | * | 4/1999 | Boffa | 508/364 |
| 6,074,993 | A | * | 6/2000 | Waddoups et al. | 508/364 |
| 6,245,719 | B1 | * | 6/2001 | Kobori | 508/110 |

FOREIGN PATENT DOCUMENTS

| | | | |
|---|---|---|---|
| EP | 0 719 851 A2 | 7/1996 | C10M/135/18 |
| EP | 0 811 674 A1 | 12/1997 | C10M/169/04 |
| WO | WO96/04356 | 2/1996 | C10M/159/12 |
| WO | WO98/23711 | 6/1998 | C10M/169/04 |
| WO | WO98/26030 | 6/1998 | C10M/159/18 |

* cited by examiner

*Primary Examiner*—Jacqueline V. Howard

(57) ABSTRACT

An SAE OW-30 or 5W-30 or 5W-20 lubricant has a Noack volatility of less than 15, optionally an M-111 fuel economy of 1.5% or less, and a chlorine content of less than 100 ppm. The lubricant comprises a basestock containing from 0 to less than 10% Group I and/or Group II basestocks, a molybdenum additive providing not greater than 1000 ppm of molybdenum to the lubricant, a calcium detergent providing 10 or greater mmoles of surfactant per kilogram of lubricant, one or more other additives, and a viscosity modifier.

14 Claims, No Drawings

LUBRICATING OIL COMPOSITION

This invention relates to multigrade lubricating oil compositions that, in particular, give enhanced performance in diesel engine ring-sticking tests.

Lubricating oil compositions (or lubricants) for the crankcase of internal combustion engines are well-known and it is also well-known for them to contain additives (or additive components) to enhance their properties and performance.

Increasingly, the demands of original equipment manufacturers (OEM's) to meet performance criteria dictate the properties of lubricants. One such performance criterion concerns the sticking of piston rings during operation of a compression-ignited (diesel) internal combustion engine. This is usually referred to briefly as "ring-sticking"; it may be measured by the VWTDi test (CEC L-78-T-97).

Other performance criteria of interest include the volatility of the lubricant, the fuel economy performance of the lubricant, and the chlorine content of the lubricant.

The various criteria clearly constrain formulators of lubricants in terms of additive components and amounts, and of basestocks, that may be used.

It has now been surprisingly found, according to this invention, that use of low concentrations of molybdenum, present as an organo molybdenum compound, can give rise to lubricants meeting demanding "ring-sticking" test requirements, whilst, at the same time, meeting other criteria.

A number of references describe the use of oil-soluble molybdenum in lubricants.

See, for example, U.S. Pat. Nos. 4,164,473; 4,176,073; 4,176,074; 4,192,757; 4,248,720; 4,201,683; 4,289,635; and 4,479,883. But none describes use for ameliorating "ring-sticking".

In a first aspect, the invention is an SAE OW-30 or 5W-30 or 5W-20 multigrade lubricating oil composition having a Noack volatility of less than 15, such as less than 13, preferably less than 11, preferably no lower than 4 or 5% mass loss according to CEC L-40-A-93; and, optionally, an M-111 fuel economy of equal to or greater than 1.5, such as 2.5%, according to CEC L-54-T-96, said composition comprising, or being made by admixing, a major amount of (A) a basestock of lubricating viscosity that contains from 0 to less than 10, preferably from 0 to less than 5, mass % of a Group I basestock or a Group II basestock or a mixture of Group I and Group II basestocks, other than basestocks that arise from provision of additive components in the composition; and minor amounts of additive components comprising (B) one or more molybdenum-containing additives in an amount providing not greater than 1000, advantageously not greater than 500, such as not greater than 350 or 300 or 250, such as no lower than 50, ppm by mass of elemental molybdenum in the composition;

(C) one or more calcium detergent additives comprising a calcium salt of an organic acid as a surfactant, in an amount or amounts providing 10 or greater, such as 12 or greater, such as up to 30 or 35, m moles of surfactant per kilogram of the composition;

(D) one or more other lubricant additives selected from ashless dispersants, metal detergents, anti-oxidants, anti-wear agents, and friction modifiers, provided they are different from additives (B) and (C) above; and (E) one or more viscosity modifiers, the additive components providing less than 100, such as less than 50, but such as no lower than 5 or 10, ppm by mass of chlorine to the composition.

In a second aspect, the invention is a method of lubricating a compression-ignited internal combustion engine comprising operating the engine and lubricating the engine with a lubricating oil composition according to the first aspect of the invention.

In a third aspect, the invention is a method of reducing the ring-sticking tendencies of a compression-ignited internal combustion engine comprising adding to the engine a lubricating oil composition according to the first aspect of the invention.

In a fourth aspect, the invention is a combination comprising the crankcase of a compression-ignited engine and a lubricating oil composition according to the first aspect of the invention for lubricating the crankcase.

In this specification:

"comprising" or any cognate word is taken to specify the presence of stated features, integers, steps or components, but does not preclude the presence or addition of one or more other features, integers, steps, components or groups thereof;

"major amount" means in excess of 50 mass % of the composition;

"minor amount" means less than 50 mass % of the composition, both in respect of the stated additive and in respect of the total mass % of all of the additives present in the composition, reckoned as active ingredient of the additive or additives;

"oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The invention also provides the product obtained or obtainable as a result of any reaction between the various additive components of the composition or concentrates, essential as well as customary and optimal, under the conditions of formulation, storage or use:

The features of the invention will now be discussed in more detail as follows:

Multigrade Lubricants

Multigrade lubricants perform over wide temperature ranges. Typically, they are identified by descriptors such as SAE 10W-30 or SAE 5W-30. The first number in the multigrade descriptor is associated with a safe cranking temperature (e.g., +20° C. ) viscosity requirement for that multigrade oil as measured by a cold cranking simulator (CCS) under high shear rates (ASTM D5293). In general, lubricants that have low CCS viscosities allow the engine to crank more easily at lower temperatures and thus improve the ability of the engine to start at those ambient temperatures.

Multiviscosity—grade oils, commonly referred to as "multigrades" are designed to operate over wide temperature ranges and are identified by descriptors such as SAE 10W-30 or SAE 5W-30. Their properties are defined in the Society of Automotive Engineers document SAE J300. This publication defines multigrades in terms of two criteria: Maximum low temperature cranking and pumping viscosities and Maximum and minimum kinematic viscosities at 100° C. and a minimum high-shear viscosity at 150° C. and $10^8{}_{s-1}$.

Low temperature properties define which "W" grade shall be assigned to a lubricant and high temperature properties define the "non W" part of the designation. SAE J300 defines a series of W grades with SAE 0W representing the requirements for operation at lowest temperatures. SAE 5W, 10W, 15W, 20W and 25W are also defined, these grades are suitable for progressively higher minimum temperature of operation. Non-W grades are also assigned a numerical designation, these define a scale of increasing high temperature viscosity. This scale starts with SAE 20 and goes through SAE 30, 40 and 50 to the most viscous grade, SAE 60.

This system of viscometric classification of automotive crankcase lubricants finds universal application with the vehicle and lubricant manufacturing industries.

Noack Volatility

Oil volatility has been associated in the technical literature with both oil consumption and exhaust emissions, both of which are undesirable. One method used to measure volatility of a lubricant is the Noack method. Two standardized Noack methods are JPI Method 5S-41-93 and CEC L-40-A-93. Those methods measure the percent mass lost after a sample has been held at a temperature of 250° C. for 60 minutes whilst air is passed through. For the purposes of this invention, all Noack volatility measurements are made using instruments that have been calibrated with a reference fluid.

Fuel Economy

M-111 fuel economy is as measured in accordance with CEC-L-54-T-96.

(A) Basestock

The basestock (sometimes referred to as "base oil") is an oil of lubricating viscosity and is the primary liquid constituent of a lubricant into which additives and possibly other oils are blended to produce the final lubricant.

Basestocks may be categorised in Groups I to V according to the API Engine Oil Licensing and Certification System (EOLCS) API 1509 definitions, which definitions are used to define the basestocks of this invention. Thus:

a) Group I basestocks contain less than 90 per cent saturates and/or greater than 0.03 per cent sulfur and have a viscosity index greater than or equal to 80 and less than 120 using the test methods specified in Table E-1.

b) Group II basestocks contain greater than or equal to 90 per cent saturates and less than or equal to 0.03 per cent sulfur and have a viscosity index greater than or equal to 80 and less than 120 using the test methods specified in Table E-1.

c) Group III basestocks contain greater than or equal to 90 per cent saturates and less than or equal to 0.03 per cent sulfur and have a viscosity index greater than or equal to 120 using the test methods specified in Table E-1.

d) Group IV basestocks are polyalphaolefins (PAO).

e) Group V basestocks include all other basestocks not included in Group I, II, III, or IV.

(B) Molybdenum-containing Additives

The molybdenum may, for example, be used in oxidation states IV, and V, such as known in the art. The molybdenum may be present as a cation, but this is not essential. Thus, for example, molybdenum-containing complexes may be used.

Examples of molybdenum compounds that may be used include the molybdenum salts of inorganic and organic acids (see, for example, U.S. Pat. No. 4, 705, 641), particularly molybdenum salts of monocarboxylic acids having from 1 to 50, preferably 8 to 18, carbon atoms, for example, molybdenum octanoate (preferably 2-ethylhexanoate), naphthenate or stearate; the reaction product of molybdenum trioxide, molybdic acid or an alkali metal salt thereof (or the reaction product of such a molybdenum compound and a reducing agent) and a secondary amine having hydrocarbon groups having 6 to 24 carbon atoms (see EP-A-205 165); overbased molybdenum-containing complexes as disclosed in EP-A-404 650, molybdenum dithiocarbamates and, less preferred because of their phosphorus content, molybdenum dithiophosphates; oil-soluble molybdenum compounds as disclosed in U.S. Pat. Nos. 4,995,996 and 4,966,719, particularly the molybdenum xanthates and thioxanthates described in those specifications; and oil-soluble molybdenum and sulfur-containing complexes. Specific molybdenum- and sulfur-containing complexes are those prepared by reacting an acidic molybdenum compound with a basic nitrogen-containing substance and then with a sulfur source (see, for example, GB-A-2 097 422), and those prepared by reacting a triglyceride with a basic nitrogen compound to form a reaction product, reacting the reaction product with an acidic molybdenum compound to form an intermediate reaction product, and reacting the intermediate reaction product with a sulfur-containing compound (see, for example, GB-A-2 220 954). Other examples of molybdenum compounds are described in International Patent Application No. PCT/IB97/01656 and comprise a trinuclear molybdenum core, optionally containing non-metallic atoms consisting wholly or partly of sulfur, and bonded thereto ligands capable of rendering the compound oil-soluble or oil-dispersible. The compounds may be represented by the general formula $Mo_3S_kL_p$. wherein L represents a ligand, for example dithiocarbamate p is in the range from 1 to 4 and k is at least 4, especially 4 to 10, preferably 4 to 7.

(C) Calcium Detergents

A detergent is an additive that reduces formation of piston deposits, for example high temperature varnish and lacquer deposits, in engines; it normally has acid-neutralising properties and is capable of keeping finely-divide Most detergents are based on metal "soaps", that is metal surfactants or salts of acidic organic compounds.

Detergents generally comprise a polar head with a long hydrophobic tail, the polar head comprising a metal salt of an acidic organic compound. The salts may contain a substantially stoichiometric amount of the metal, in which case they are usually described as normal or neutral salts, and would typically have a total base number or TBN (as may be measured by ASTM D2896) of from 0 to 80. Large amounts of a metal base can be included by reacting an excess of a metal compound, such as an oxide or hydroxide, with an acidic gas such as carbon dioxide. The resulting overbased detergent comprises neutralised detergent as the outer layer of a metal base (e.g. carbonate) micelle. Such overbased detergents may have a TBN of 150 or greater, and typically of from 250 to 450 or more.

The calcium detergents that may be used include oil-soluble neutral and overbased sulfonates, phenates, sulfurized phenates, thiophosphonates, salicylates, and naphthenates. Particularly convenient calcium detergents are neutral and overbased calcium sulfonates having a TBN of from 20 to 450 TBN, and neutral and overbased calcium phenates and sulfurized phenates having a TBN of from 50 to 450.

Sulfonates may be prepared from sulfonic acids, which are typically obtained by the sulfonation of alkyl-substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst using alkylating agents having from 3 to more than 70 carbon atoms. Alkaryl sulfonates usually contain from 9 to 80 or more, preferably from 16 to 60, carbon atoms per alkyl-substituted aromatic moiety.

Oil-soluble sulfonates or alkaryl sulfonic acids may be neutralised with oxides, hydroxides, alkoxides, carbonates, carboxylate, sulfides, hydrosulfides, nitrates, borates and ethers of the calcium. The amount of calcium compound is chosen having regard to the desired TBN of the final product but typically ranges from about 100 to 220, preferably at least 125, mass %.

Calcium salts of phenols and sulfurised phenols are prepared by reaction of the phenol with an appropriate calcium compound such as an oxide or hydroxide, and neutral or overbased products may be obtained by methods known in the art. Sulfurised phenols may be prepared by reacting a phenol with sulfur or a sulfur-containing compound such as hydrogen sulfide, sulfur monohalide or sulfur dihalide to form products which are generally mixtures of compounds in which two or more phenols are bridged by sulfur-containing bridges.

(D) Other Lubricant Additives ashless dispersants are non-metallic organic materials that form substantially no ash on combustion. Their primary function is to hold solid and liquid contaminants in suspension and they comprise long-chain hydrocarbons, to confer oil-solubility, with a polar head capable of associating with particles to be dispersed. A noteworthy group is hydrocarbon-substituted succinimides anti-oxidants increase the composition's resistance to oxidation and may work by combining with and modifying peroxides to render them harmless by decomposing peroxides or by rendering an oxidation catalyst inert. They may be classified as radical scavengers (e.g. sterically hindered phenols, secondary aromatic amines, and organo-copper salts); hydroperoxide decomposers (e.g. organo-sulfur and additives); and multifunctionals. In the practice of the present invention, the use or otherwise of certain anti-oxidants may confer certain benefits. For example, in one embodiment it may be preferred that the lubricating oil composition is free of any secondary aromatic amine anti-oxidants. In another embodiment, it may be preferred to employ in the lubricating oil composition a combination of one or more secondary aromatic amine anti-oxidants (e.g. in the range of 0.1 to 0.7, preferably 0.2 to 0.5, mass % of the composition) and one or more sterically hindered phenol anti-oxidants (e.g. in the range of 0.1 to 2, preferably 0.5 to 1.5 mass % of the composition); such composition may for example contain one or more molybdenum-containing additives in an amount providing from 50 or 100 to 500 or 700 ppm by mass of elemental molybdenum in the composition.

anti-wear agents reduce friction and excessible wear and are usually based on compounds containing sulfur or phosporus or both. Noteworthy are metal dihydrocarbyl dithiophosphates such as zinc dialkyl dithiophosphates (ZDDP's). Preferably, the alkyl groups are essentially secondary alkyl groups.

friction modifiers include boundary additives that lower friction coefficients and hence improve fuel economy. Examples are esters of polyhydric alcohols such as glycerol monoesters of higher fatty acids, for example glycerol mono-oleate; esters of long chain polycarboxylic acids with diols, for example the butane diol esters of dimerized unsaturated fatty acids; oxazoline compounds; and alkoxylated alkyl-substituted monoamines, and alkyl ether amines, for example, ethoxylated tallow amine and ethoxylated tallow ether amine. Preferably, in the practice of this invention, component (s) (D) includes one or more friction modifiers selected from esters of polyhydric alcohols and from alkoxylated amines.

(E) Viscosity Modifiers

Viscosity modifiers (or viscosity index improvers) impart high and low temperature operability to a lubricating oil. Viscosity modifiers that also function as dispersants are also known and may be prepared as described above for ashless dispersants. In general, these so-called dispersant viscosity modifiers are functionalized polymers (e.g. interpolymers of ethylene-propylene post-grafted with an active monomer such as maleic anhydride) which are then derivatized with, for example, an alcohol or amine.

Suitable compounds for use as viscosity modifiers are generally high molecular weight hydrocarbon polymers, including polyesters. Oil-soluble viscosity modifying polymers generally have weight average molecular weights of from 10,000 to 1,000,000, preferably 20,000 to 500,000, which may be determined by gel permeation chromatography or by light scattering.

Representative examples of suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, interpolymers of styrene and acrylic esters, and partially hydrogenated copolymers of styrene, isoprene, styrene/butadiene, and isoprene/butadiene, as well as the partially hydrogenated homopolymers of butadiene and isoprene and isoprene/divinylbenzene.

Other known additives may be incorporated into the lubricating oil compositions of the invention, being different from those defined in the invention. They may, for example, include other detergents; rust inhibitors; corrosion inhibitors; pour point depressants; anti-foaming agents; and surfactants. They can be combined in proportions known in the art.

As is known in the art, some additives can provide a multiplicity of effects; thus, for example, a single additive may act both as a dispersant and as an anti-oxidant.

As stated above, the additives provide less than 50 ppm by mass of chlorine to the composition. Thus, to meet this requirement, the use of chlorine-containing additives (e.g. arising from their method of manufacture) must be eliminated or at least controlled.

Concentrate Definition

In the preparation of lubricating oil compositions, it is common practice to introduce additive(s) therefor in the form of concentrates of the additive(s) in a suitable oleaginous, typically hydrocarbon, carrier fluid, e.g. mineral lubricating oil, or other suitable solvent. Oils of lubricating viscosity such as described herein, as well as aliphatic, naphthenic, and aromatic hydrocarbons, are examples of suitable carrier fluids for concentrates.

Concentrates constitute a convenient means of handling additives before their use, as well as facilitating solution or dispersion of additive in lubricating oil compositions. When preparing a lubricating oil composition that contains more than one type of additive, each additive may be incorporated separately—each in the form of a concentrate. In many instances, however, it is convenient to provide a so-called additive "package" (also referred to as an "adpack") comprising two or more additives in a single concentrate.

A concentrate may contain 1 to 90, such as 10 to 80, preferably 20 to 80, more preferably 20 to 70, mass % active ingredient of the additive or additives.

Making Compositions

Lubricating oil compositions may be prepared by adding to an oil of lubricating viscosity a mixture of an effective minor amount of at least one additive and, if necessary, one or more co-additives such as described hereinafter. This preparation may be accomplished by adding the additive directly to the oil or by adding it in the form of a concentrate thereof to disperse or dissolve the additive. Additives may be added to the oil by any method known to those skilled in the art, either prior to, contemporaneously with, or subsequent to addition of other additives.

The lubricating oil compositions may be used to lubricate mechanical engine components, particularly an internal combustion, such as a compression-ignited engine, by adding the lubricating oil thereto. Particular examples of compression-ignited engine are those developed in recent years where the top ring groove temperature may exceed 150° C. due to increases in specific power output to around 40 kW/liter or greater. These engines are more prone to suffer from ring-sticking problems in their operation.

When concentrates are used to make the lubricating oil compositions, they may for example be diluted with 3 to 100, e.g. 5 to 40, parts by mass of oil of lubricating viscosity per part of the concentrate.

When lubricating oil compositions contain one or more additives, each additive is typically blended into the base oil in an amount which enables the additive to provide its desired function. Representative effective amounts of such additives, when used in crankcase lubricants, are listed below. All the values listed herein are stated as mass per cent active ingredient, unless otherwise indicated.

| ADDITIVE | MASS % (Broad) | MASS % (Preferred) |
|---|---|---|
| Ashless Dispersant | 0.1–20 | 1–8 |
| Metal detergents | 0.1–6 | 0.2–4 |
| Corrosion Inhibitor | 0–5 | 0–1.5 |
| Metal dihydrocarbyl dithiophosphate | 0.1–6 | 0.1–4 |
| Supplemental anti-oxidant | 0–5 | 0.01–1.5 |
| Pour Point Depressant | 0.01–5 | 0.01–1.5 |
| Anti-Foaming Agent | 0–5 | 0.001–0.15 |
| Supplemental Anti-wear Agents | 0–0.5 | 0–0.2 |
| Friction Modifier | 0–5 | 0–1.5 |
| Viscosity Modifier | 0.01–6 | 0–4 |
| Mineral or Synthetic Base Oil | Balance | Balance |

The final composition may contain from 5 to 25, preferably 5 to 18, typically 10 to 15, mass % of the concentrate, the remainder being oil of lubricating viscosity.

EXAMPLES

The invention will now be particularly described, by way of example only, as follows:

Four additive packages (or "adpacks") were prepared by methods known in the art and identified as Packages 1, A, 2 and B. The packages were identical except that Packages 1 and 2 contained molybdenum (in the same concentrations) and Packages A and B did not, and that Packages 1 and A contained less dispersant than Packages 2 and B, Packages 1 and A having identical dispersant-concentrations, and Packages 2 and B having identical dispersant-concentrations.

Each package contained the following additives in the same concentrations:

polybutene succinimide dispersant
overbased calcium sulfonate detergent
overbased magnesium sulfonate detergent
neutral calcium sulfonate detergent
neutral calcium phenate
hindered phenol antioxidant
ethoxylated amine friction modifier
glycerol mono-oleate friction modifier
zinc dialkyl dithiophosphate anti-wear agent
silicone anti-foamant
demulsifier
diluent oil Packages 1 and 2 contained a trinuclear molybdenum/sulfur thiocarbamate. Packages 1 and A contained less dispersant than Packages 2 and B.

Each package was blended into a Group IV basestock mixture to give an SAE 0W-30 lubricating oil composition (or oil) having the following characteristics, wherein each oil is identified by the same reference numeral or letter as the package from which it was blended.

| | OIL | | | |
|---|---|---|---|---|
| | 1 | A | 2 | B |
| Noack Volatility | 10.7 | 10.6 | 11 | 10.6 |
| Cl-content (ppm) | 26 | 26 | 26 | 26 |
| Mo-content (ppm) | 100 | 0 | 100 | 0 |
| Surfactant content (mmoles/Kg) | 14.2 | 14.2 | 14.2 | 14.2 |
| Dispersant content (mass %) | 2.6 | 2.6 | 3.5 | 3.5 |

Tests and Results Samples of each of Oils 1A, 2 and B were subjected to VWTDi CEC-L-78-T-97 tests.

The results are set out in the table below.

| | OIL | | | |
|---|---|---|---|---|
| | 1 | A | 2 | B |
| merits[1] | 65 | 46 | 68 | 56 |
| ring stick[2] (average) | 0 | 2.63 | 0 | 0.63 |
| ring stick[3] (maximum) | 0 | 5.0 | 0 | 2.5 |

Each test was run to its full duration, ie not terminated prematurely

1. ACEA B4 limit is >65
2. ACEA B4 limit is <0.7
3. ACEA B4 limit is <2.5

The results clearly demonstrate the beneficial effect of low levels of molybdenum in the tests. Thus, their incorporation converts oils from those that fail the test to those that comfortably pass, which is observed at both high and low dispersant levels.

In a further example of the invention, an SAE 5W-30 lubricating oil composition (Oil 3) was prepared that contained a trinuclear molybdenum/sulfur thiocarbamate additive providing 300 ppm by mass of elemental molybdenum, a diphenyl-amine anti-oxidant (0.35 mass %), and a hindered phenol antioxidant (1.1 mass %). Oil 3 other properties falling within those of the compositions of the first aspect of the invention.

Oil 3 was tested in the API Seq III test, but carried out for twice the stipulated length of time (128 hours as opposed to 64 hours). The stipulated test is concerned with piston cleanliness, cam and lifter wear, and viscosity growth in the oil. Doubling the duration of the tests increases its severity: under these conditions, the viscosity growth usually becomes the limiting factor and hence control of oil viscosity by use of additives becomes critical.

The results obtained were as follows:

| Hours | Viscosity Increase % |
|---|---|
| 0 | 0 |
| 8 | 5 |
| 16 | 8 |
| 24 | 11 |
| 32 | 13 |
| 40 | 15 |
| 48 | 17 |
| 56 | 19 |
| 64 | 21 |
| 72 | 22 |
| 80 | 23 |
| 88 | 24 |
| 96 | 26 |
| 104 | 27 |
| 112 | 28 |
| 120 | 31 |
| 128 | 34 |

Under the ACEA AI-98 (ASTM D 5533) specification for the Seq III E test, the oil viscosity increase at 40° C. must be ≦100%. The above results therefore demonstrate that the oil tested (Oil 3), employing a mixture of two different anti-oxidants, showed exceptional performance in the severe version of that test carried out as described above.

What is claimed is:

1. An SAE 0W-30 or 5W-30 or 5W-20 multigrade compression-ignited engine lubricating oil composition having a Noack volatility of less than 15% mass loss according to CEC L-40-A-93 and a merit of at least 65 in the VWTDi test according to CEC-L-78-T-97, said composition comprising, or being made by admixing, a major amount of (A) a basestock of lubricating viscosity that contains from 0 to less than 10 mass % of a Group I basestock or a Group II basestock or a mixture of Group I and Group II basestocks, other than basestocks that arise from provision of additive components in the composition; and minor amounts of additive components comprising (B) one or more molybdenum-containing additives in an amount providing not greater than 1000 ppm by mass of elemental molybdenum, in the composition;

(C) one or more calcium detergent additives comprising a calcium salt of an organic acid as a surfactant, in an amount or amounts providing at least 10 m moles of surfactant per kilogram of the composition;

(D) one or more other lubricant additives selected from ashless dispersants, metal detergents, anti-oxidants, anti-wear agents, and friction modifiers, provided that said other lubricant additives are different from additives (B) and (C) above; and (E) one or more viscosity modifiers, the additive components providing less than 100 ppm by mass of chlorine to the composition.

2. The composition as claimed in claim 1 free of one or more secondary aromatic amine anti-oxidants.

3. The composition as claimed in claim 1 containing a secondary aromatic amine anti-oxidant and a sterically hindered phenol anti-oxidant.

4. The composition as claimed in claim 1, wherein component (D) includes one or more friction modifiers selected from esters of polyhydric alcohols and alkoxylated amines.

5. The composition as claimed in claim 1, wherein component (C) is an overbased calcium salt of an organic acid, said acid being a phenol or a sulfonic acid such that the surfactant is a phenate or a sulfonate.

6. The composition as claimed in claim 1, wherein the molybdenum-containing additive comprises an oil-soluble molybdenum compound comprising a molybdenum core and, bonded thereto, one or more ligands conferring oil-solubly.

7. The composition as claimed in claim 6 wherein the molybdenum core is a dinuclear or a trinuclear molybdenum core, or a combination thereof, optionally containing non-metallic atoms consisting wholly or partly of sulfur.

8. The composition as claimed in claim 6 wherein the ligand or ligands are dialkyl dithiocarbamate or dialkyl dithiophosphate.

9. The composition as claimed in claim 1, further comprising a zinc dialkyl dithiophosphate additive in which the alkyl groups are secondary alkyl groups.

10. A method of lubricating a compression-ignited internal combustion engine comprising operating the engine and lubricating the engine with a lubricating oil composition as claimed in claim 1.

11. A method of reducing the ring-sticking tendencies of a compression-ignited internal combustion engine comprising adding to the engine a lubricating oil composition as claimed in claim 1.

12. A composition of claim 1 that provides an M-111 fuel economy of equal to or greater than 1.5% according to CEC L-54-T-96.

13. The composition of claim 1, wherein said on or more molybdenum-containing additives are present in an amount providing said composition with not greater than 500 ppm by mass of elemental molybdenum.

14. The composition of claim 13, wherein said one or more molybdenum-containing additives are present in an amount providing said composition with not greater than 250 ppm by mass of elemental molybdenum.

* * * * *